US007141345B2

(12) United States Patent
Yamasaki et al.

(10) Patent No.: US 7,141,345 B2
(45) Date of Patent: Nov. 28, 2006

(54) RESIN PARTICLES FOR TONER AND TONER PREPARED THEREWITH

(75) Inventors: Hiroyuki Yamasaki, Amagasaki (JP); Yoshitaka Sekiguchi, Nishinomiya (JP); Chiyoshi Nozaki, Otsu (JP); Masahiro Anno, Hachioji (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 252 days.

(21) Appl. No.: 10/791,807

(22) Filed: Mar. 4, 2004

(65) Prior Publication Data

US 2005/0069801 A1 Mar. 31, 2005

(30) Foreign Application Priority Data

Sep. 26, 2003 (JP) ..... 2003-335156

(51) Int. Cl.
*G03G 9/093* (2006.01)

(52) U.S. Cl. ..... 430/110.2; 430/108.1; 430/111.4; 430/137.14

(58) Field of Classification Search ..... 430/110.2, 430/108.1, 111.4, 137.14
See application file for complete search history.

(56) References Cited

U.S. PATENT DOCUMENTS 5,766,817 A 6/1998 Cheng et al.
6,309,787 B1 * 10/2001 Cheng ..... 430/137.14
6,413,692 B1 * 7/2002 Cheng ..... 430/137.14
6,455,220 B1 * 9/2002 Cheng ..... 430/137.14
6,617,091 B1 * 9/2003 Nishimori et al. ..... 430/137.11
6,753,122 B1 * 6/2004 Ohmura et al. ..... 430/107.1

FOREIGN PATENT DOCUMENTS

| | | |
|---|---|---|
| JP | 03-096965 | 4/1991 |
| JP | 09-292739 | 11/1997 |
| JP | 11-242359 | 9/1999 |
| JP | 2001-131213 | 5/2001 |
| JP | 2001-290308 | 10/2001 |
| JP | 2002-049180 | 2/2002 |
| JP | 2002-107994 | 4/2002 |
| JP | 2002-372805 | 12/2002 |
| JP | 2003-149867 | 5/2003 |
| JP | 2003-183312 | 7/2003 |

* cited by examiner

*Primary Examiner*—John L Goodrow
(74) *Attorney, Agent, or Firm*—Buchanan Ingersoll & Rooney PC

(57) ABSTRACT

The present invention provides a resin particle for toner, which is allowed to contain colorant particles and/or charge-controlling agent particles through a miniemulsion method, and a toner prepared with the resin particles aggregated/fused.

22 Claims, 2 Drawing Sheets

RESIN PARTICLES FOR TONER AND TONER PREPARED THEREWITH

This application is based on application No.2003-335156 filed in Japan, the contents of which are hereby incorporated by reference.

BACKGROUND OF THE INVENTION

1. Field of the Invention

The present invention relates to a toner for use in an electrophotographic method and resin particles that are used for manufacturing the toner.

2. Description of the Related Art

The toner for use in electrophotography is normally composed of toner particles that are formed by adding additives such as a colorant, a charge-controlling agent and a wax to a binder resin. It has been known that such toner particles are manufactured by using a so-called emulsion polymerizing coagulation method. In the emulsion polymerizing coagulation method, in general, resin particles, obtained by an emulsion polymerizing process, are allowed to aggregate/fuse to one another to prepare toner particles. In such a method, the colorant, the charge-controlling agent and the wax are generally added at the time of the aggregating/fusing processes. It has been known that, in particular, the wax is added upon obtaining resin particles through an emulsion polymerization method, in particular, through a miniemulsion polymerization method in which oil droplets obtained at the time of the emulsifying process are small (see Japanese Patent Application Laid-Open Nos. 2002-49180, 2002-107994 and 2002-372805).

However, the toner obtained through the above-mentioned conventional methods has a problem in that it fails to provide sufficient image density. Since it fails to provide sufficient charging stability and since, in particular, it has a great fluctuation in quantity of charge upon having an environmental fluctuation, fogging occurs in response to even a slight environmental change.

SUMMARY OF THE INVENTION

An objective of the present invention is to provide a toner that ensures sufficient image density even in the case of a comparatively low amount of toner adhesion and resin particles that are capable of forming such a toner.

Another objective of the present invention is to provide a toner that exerts superior charging stability against environmental fluctuations and resin particles that are capable of forming such a toner.

Still another objective of the present invention is to provide a toner that ensures sufficient image density even in the case of a comparatively low amount of toner adhesion and exerts superior charging stability against environmental fluctuations, and resin particles that are capable of forming such a toner.

The present invention relates to a resin particle for toner, which is allowed to contain colorant particles and/or charge-controlling agent particles through a miniemulsion method, and a toner prepared with the resin particles aggregated/fused.

DETAILED DESCRIPTION OF THE INVENTION

Figure 1:
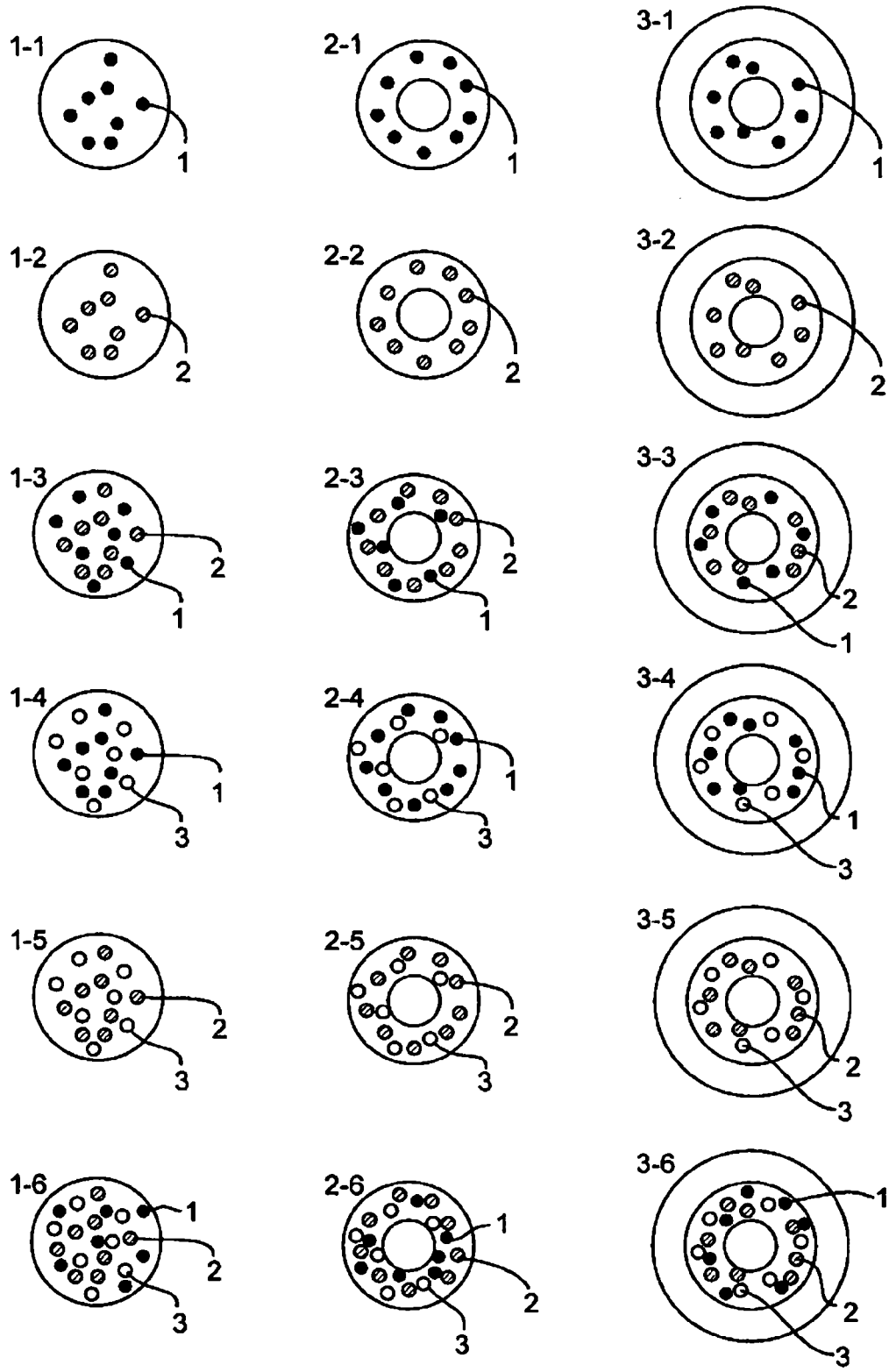
FIG. 1 shows schematic sectional views of resin particles for toners of the present invention.

Toner particles contained in a toner of the present invention are formed by allowing at least resin particles to aggregate/fuse to one another.

In the present specification, the term "aggregation" is used as the concept that at least a plurality of resin particles are simply allowed to adhere to one another. Although constituent particles are made in contact with one another through "aggregation", bonds, which are made through fusion between the resin particles, are not formed; thus, so-called hetero-aggregated particles (group) are formed. The particle group, formed through such "aggregation", is referred to as "aggregated particles".

The term "fusion" is used as the concept that a bond is formed through melting between resin particles at least one portion on the interface of the respective constituent particles in the aggregated particles to provide one particle that forms a unit in use and handling. The group of particles that are subjected to such "fusion" are referred to as "fused particles".

The term "aggregation/fusion" indicates the fact that aggregating and fusing processes are carried out simultaneously or step by step, or the action that allows the aggregating and fusing processes to take plate simultaneously or step by step.

In the present invention, resin particles are formed to contain at least either the colorant particles or the charge-controlling agent particles through a mini-emulsion polymerization method.

The resin particles may have any structure as long as at least either the colorant particles or the charge-controlling agent particles are contained therein through a miniemulsion polymerization method, and may include, for example, a center portion serving as a core, and/or an outer layer serving as a surface layer. Specific examples of structures of such resin particles include structures (1-1) to (1-6), (2-1) to (2-6) and (3-1) to (3-6). Hereinafter, a layer, which contains at least either the colorant particles or the charge-controlling agent particles, is referred to as a functional layer.

More specifically, resin particles having structures (1-1) to (1-6) include neither the center portion nor the outer layer, and have a single-layer particle structure made up of only the functional layer, and the functional layer may contain another toner component such as a wax 3, as long as it contains at least either colorant particles 1 or charge-controlling agent particles 2. Preferably, a wax is contained therein.

The resin particles of structures (2-1) to (2-6) have a structure in which functional layers are laminated on the center portions, and the functional layer may contain another toner component such as a wax 3, as long as it contains at least either the colorant particles 1 or the charge-controlling agent particles 2. Preferably, the wax is contained in the functional layer. In the present invention, among the above-mentioned structures, the resin particles, which have the structure in which either the colorant particles or the charge-controlling agent particles are contained in the functional layer, may contain the other particles and/or wax particles in the center portion.

The resin particles having structures (3-1) to (3-6) have a structure in which a functional layer and an outer layer are successively laminated on the center portion, and the functional layer may contain another toner component such as a wax 3, as long as it contains at least either the colorant particles 1 or the charge-controlling agent particles 2. Preferably, the wax is contained in the functional layer. In the present invention, among the above-mentioned structures, the resin particles, which have the structure in which either the colorant particles or the charge-controlling agent particles are contained in the functional layer, may contain the other particles and/or wax particles in the center portion and/or the outer layer.

The forming method of the resin particles is not particularly limited, as long as the functional layer, which contains at least either the colorant particles or the charge-controlling agent particles, is formed through a miniemulsion polymerization method.

In the miniemulsion method, a polymer composition containing at least a polymerizable monomer is dispersed in a form of oil droplets in an aqueous medium prepared by dissolving a surfactant in a concentration of less than the critical micelle concentration by applying mechanical energy so that a miniemulsion dispersion solution is obtained, and this miniemulsion dispersion solution is used for carrying out a polymerizing process. In this method, by adding a desired toner component, such as colorant particles and charge-controlling agent particles to the polymer composition, the toner component is contained in the resin particles, in particular, in the functional layer. The particle size of the dispersed oil droplets in the miniemulsion dispersion solution is normally in a range from 10 to 300 nm, preferably from 50 to 100 nm, although it varies depending on the composition of the oil droplets. With respect to the dispersing machine to be used for carrying out the oil droplet dispersion by mechanical energy, although not particularly limited as long as the above-mentioned particle size of the dispersed particles is obtained, examples thereof include a dispersing machine "CLEARMIX" (made by M Technique) having a high-speed rotating rotor, an ultrasonic dispersing machine, a mechanical homogenizer, a Manton-Gourin Homogenizer and a pressure homogenizer.

As described above, since the functional layer is formed by using the miniemulsion polymerization method which forms oil droplets mechanically, a desired toner component (for example, colorant particles and/or charge-controlling agent particles and wax particles, if necessary) added to the polymer composition can be absorbed uniformly with a small size. For this reason, even when the added amount of the colorant particles and/or the charge-controlling agent particles is comparatively small, it is possible to ensure sufficient toner quality (image density and/or charging stability). Even when the added amount of the colorant particles and/or the charge-controlling agent particles is comparatively great, these particles are effectively directed into the resin particles, in particular, into the functional layer, without causing separation; thus, it becomes possible to further improve the toner quality (image density and/or charging stability).

For example, in the forming method of the resin particles having structures (1-1) to (1-6), a polymerization initiator is added to the above-mentioned miniemulsion dispersion solution obtained by using a polymer composition containing a desired toner component, and this is heated and stirred so that a radical polymerization (miniemulsion polymerization) process is carried out in the oil droplets. The weight-average molecular weight of the resulting particles is normally from 10,000 to 400,000, preferably from 20,000 to 100,000.

For example, in the forming method of the resin particles having structures (2-1) to (2-6), after a polymer composition containing a polymerizable monomer has been dispersed in a form of oil droplets in an aqueous medium (aqueous solution of a surfactant), this system is heated and stirred to carry out a polymerizing process (first-stage polymerization) so that a dispersion solution of center portion particles is prepared. The above-mentioned miniemulsion dispersion solution, obtained by using a polymer composition containing a desired toner component, and a polymerization initiator are added to this dispersion solution, and heated and stirred to carry out a polymerizing process (second-stage polymerization (miniemulsion polymerization)) so that a functional layer is formed on the surface of each of the center portion particles. In this structure, the weight-average molecular weight of the center portion is normally from 10,000 to 400,000, preferably from 10,000 to 50,000. The weight-average molecular weight of the functional layer is normally from 10,000 to 400,000, preferably from 20,000 to 100,000.

For example, in the forming method of the resin particles having structures (3-1) to (3-6), the same processes as the above-mentioned forming method of the resin particles having structures (2-1) to (2-6) are carried out except that the polymerizing conditions are set so as to place the weight-average molecular weights of the center portion and the functional layer in respective ranges that will be described later; thus, a dispersion solution having composite resin particles each of which has a functional layer formed in the center portion thereof is prepared. A polymer composition containing a polymerizable monomer and a polymerization initiator are added to the resulting dispersion solution of the composite resin particles, and heated and stirred to carry out a polymerizing process (third-stage polymerization) so that an outer layer is formed on the surface of each of the composite resin particles. In this structure, the weight-average molecular weight of the center portion is normally from 10,000 to 400,000, preferably from 10,000 to 50,000. The weight-average molecular weight of the functional layer is normally from 10,000 to 400,000, preferably from 20,000 to 100,000. The weight-average molecular weight of the outer layer is normally from 10,000 to 400,000, preferably from 10,000 to 50,000.

With respect to the polymerization temperature and the polymerization time, these may be appropriately set within a range that allows a polymerizing reaction to take place.

In any of the cases in which resin particles having any one of the above-mentioned structures are formed, the usable polymer composition, aqueous medium and components constituting these are commonly adopted except that the aqueous medium forming the miniemulsion dispersion solution has a surfactant concentration that is less than the critical micelle concentration.

With respect to the polymerizable monomer, not particularly limited as long as it is a monomer capable of forming an addition polymerization-type resin to be used for a toner-use binder resin, and examples thereof include: styrenes, such as styrene, o-methylstyrene, m-methylstyrene, p-methylstyrene, α-methylstyrene, p-chlorostyrene, 3,4-dichlorostyrene, p-n-butylstyrene, p-tert-butylstyrene, p-nonylstyrene and p-phenylstyrene; acrylic acid esters, such as methyl acrylate, ethyl acrylate, propyl acrylate, n-butyl acrylate, isobutyl acrylate, hydroxyethyl acrylate, and 2-ethylhexyl acrylate; methacrylic acid esters, such as methyl methacrylate, ethyl methacrylate, propyl methacrylate, n-butyl methacrylate, isobutyl methacrylate, hydroxyethyl methacrylate and 2-ethylhexyl methacrylate; cyclohexene, acrylonitrile, methacrylonitrile, vinyl chloride and vinyl acetate.

With respect to the polymerizable monomer, an acid monomer having an acidic polar group may be used. With respect to the acidic monomer, examples thereof include monomers of acids having a carboxyl group, such as acrylic acid, methacrylic acid, maleic acid, maleic anhydride, fumaric acid and cinnamic acid, and monomers having a sulfonic acid group such as sulfonated styrene.

In the present invention, with respect to the polymerizable monomer, styrene and acrylic acid esters (and/or methacrylic acid esters) are preferably used, and with respect to acidic monomers, acrylic acid and methacrylic acid are preferably used.

With respect to the polymerizable monomer, a crosslinking-type monomer may be used. With respect to the crosslinking-type monomer, examples of the crosslinking-type monomer include: compounds having two or more unsaturated bonds, such as divinyl benzene, divinyl naphthalene, divinyl ether, diethylene glycol dimethacrylate, ethylene glycol dimethacrylate, 1,6-hexane diol diacrylate, polyethylene glycol dimethacrylate, diallyl phthalate, butadiene and isoprene.

In addition to the above-mentioned monomers, a known chain transfer agent is normally contained in the polymerization composition on demand, so as to adjust the molecular weight of the polymer. Specific examples of the chain transfer agent include: n-octyl mercaptan, n-dodecyl mercaptan, t-dodecyl mercaptan, 2-mercaptoethanol, diisopropyl xanthogen, carbon tetrachloride, trichlorobromomethane, octan thiol, stearyl thiol, n-octyl 3-mercaptopropionate, α-methyl styrene dimer and ethylene glycol bis(3-mercaptopropionate). These chain transfer agents can be used solely, or two or more of them can be used in combination.

With respect to a surfactant to be contained in the aqueous medium, at least one kind selected from a cationic surfactant, an anionic surfactant and a nonionic surfactant is used. Two or more kinds of these surfactants may be used in combination. Among these, in particular, an anionic surfactant is mainly used preferably.

Specific examples of the cationic surfactant include: dodecylammonium chloride, dodecylammonium bromide, dodecyltrimethylammonium bromide, dodecylpyridinium chloride, dodecylpyridinium bromide and hexadecyltrimethylammonium bromide.

With respect to the anionic surfactant, preferable specific examples thereof include ionic surfactants, such as sulfonates (sodium dodecylbenzene sulfonate, sodium arylalkylpolyether sulfonate, etc.), sulfates (sodium dodecyl sulfate, sodium tetradecyl sulfate, sodium pentadecyl sulfate, sodium octyl sulfate, etc.) and fatty acid salts (sodium oleate, sodium laurate, sodium caprinate, sodium caprylate, sodium caproate, potassium stearate, calcium oleate, etc.). Nonionic surfactants, such as polyethylene oxide, polypropylene oxide, a combination of polypropylene oxide and polyethylene oxide, esters between polyethylene glycol and higher fatty acid, alkylphenol polyethylene oxide, esters between higher fatty acid and polyethylene glycol, esters between higher fatty acid and polypropylene oxide and sorbitan esters, may be used.

Each of these surfactants is used as an emulsifier at-the time of emulsion polymerization, or may be used in another process or for another purpose.

The polymerization initiator to be used in the emulsion polymerization method is not particularly limited as long as it is water-soluble, and examples thereof include: persulfates such as potassium persulfate, sodium persulfate and ammonium persulfate, and a redox initiator formed by combining one of these persulfates used as one component with a reducing agent such as acidic sodium sulfite; water-soluble polymerization initiators, such as hydrogen peroxide, 4,4'-azobis-cyanovalerate, t-butyl hydroperoxide and cumene hydroperoxide, and a redox initiator formed by combining one of these water-soluble polymerization initiators serving as one component with a reducing agent such as ferrous salt; benzoyl peroxide and 2,2'-azobis-isobutylonitrile. These polymerization initiators may be added to the polymerizing system at any of the timings, that is, before the addition of the monomer, simultaneously with the addition thereof and after the addition thereof, and these addition methods may be combined, if necessary.

With respect to the colorants to be used in the present invention, various kinds of inorganic pigments, organic pigments and dyes are listed. With respect to the inorganic pigments, conventionally known pigments may be used. Although any pigment may be used, preferable examples of the inorganic pigments are shown below: With respect to the black pigments, examples thereof include: carbon blacks such as Furnace Black, Channel Black, Acetylene Black, Thermal Black and Lamp Black, as well as magnetic powder such as magnetite and ferrite. These inorganic pigments may be used alone or a plurality of these may be used in combination, on demand.

With respect to the organic pigments, those of conventionally known pigments may be used. Any of those pigments may be used; and specific organic pigments are shown below.

With respect to magenta or red pigments, examples thereof include: C.I. Pigment Red 2, C.I. Pigment Red 3, C.I. Pigment Red 5, C.I. Pigment Red 6, C.I. Pigment Red 7, C.I. Pigment Red 15, C.I. Pigment Red 16, C.I. Pigment Red 48:1, C.I. Pigment Red 53:1, C.I. Pigment Red 57:1, C.I. Pigment Red 81:3, C.I. Pigment Red 122, C.I. Pigment Red 123, C.I. Pigment Red 139, C.I. Pigment Red 144, C.I. Pigment Red 149, C.I. Pigment Red 166, C.I. Pigment Red 177, C.I. Pigment Red 178, C.I. Pigment Red 184, C.I. Pigment Red 185, C.I. Pigment Red 222 and C.I. Pigment Red 238.

With respect to orange or yellow pigments, examples thereof include: C.I. Pigment Orange 31, C.I. Pigment Orange 43, C.I. Pigment Yellow 12, C.I. Pigment Yellow 13, C.I. Pigment Yellow 14, C.I. Pigment Yellow 15, C.I. Pigment Yellow 17, C.I. Pigment Yellow 74, C.I. Pigment Yellow 93, C.I. Pigment Yellow 94, C.I. Pigment Yellow 97, C.I. Pigment Yellow 138 and C.I. Pigment Yellow 180.

With respect to green or cyan pigments, examples thereof include: C.I. Pigment Blue 15, C.I. Pigment Blue 15:2, C.I. Pigment Blue 15:3, C.I. Pigment Blue 16, C.I. Pigment Blue 60 and C.I. Pigment Green 7.

With respect to dyes, examples thereof include: C.I. Solvent Reds 1, 49, 52, 58, 63, 111 and 122; C.I. Solvent Yellows 19, 44, 77, 79, 81, 82, 93, 98, 103, 104, 112 and 162; and C.I. Solvent Blues 25, 36, 60, 70, 93 and 95. A mixture of these may be used.

These organic pigments and dyes may be used alone or a plurality of these may be selected and used in combination, on demand.

With respect to the used amount of the colorant, not particularly limited, any amount may be used as long as the content of the colorant in the toner is set within the following range.

For example, in the case of adding the colorant in resin particles of each of the above-mentioned structures (1-1) to (1-6), the used amount is set so that the content of the colorant is not more than 35% by weight, preferably in a range from 3 to 16% by weight, with respect to the entire resin particles.

For example, in the case of adding the colorant in resin particles of the above-mentioned structures (2-1) to (2-6), the used amount is set so that the content of the colorant is not more than 31% by weight, preferably in a range from 3 to 14% by weight, with respect to the entire resin particles.

For example, in the case of adding the colorant in resin particles of the above-mentioned structures (3-1) to (3-6), the-used amount is set so that the content of the colorant is not more than 13% by weight, preferably in a range from 3 to 6% by weight, with respect to the entire resin particles.

Here, two kinds or more of colorants may be used as long as the resulting toner has a desired color, and in this case, the content of those colorants is preferably set in the above-mentioned range.

For example, in the case when a desired color of the toner is a cyan color within a range of visible light rays (380 to 780 nm), the colorants are properly selected so that the maximum peak in the transmission density chart of an image is set in a range of 580 to 780 nm.

Here, for example, in the case when a desired color of the toner is a magenta color, the colorants are properly selected so that the maximum peak in the transmission density chart of an image is set in a range of 480 to 580 nm.

For example, in the case when a desired color of the toner is a yellow color, the colorants are properly selected so that the maximum peak in the transmission density chart of an image is set in a range of 380 to 480 nm.

For example, in the case when a desired color of the toner is a black color, the colorants are properly selected so that the maximum peak in the transmission density chart of an image is set in a range of 380 to 780 nm.

With respect to the charge-controlling agent, desired known charge-controlling agents may be used alone or in combination. In the case when color-toner applicability (the property in which the charge-controlling agent causes no color-tone problems to the toner even in the case of colorless or faded color toner) is taken into consideration, as for the positively chargeable agent, quaternary ammonium chlorides are preferably used, and as for the negatively chargeable agent, metal salts and metal complexes between metals such as chromium, zinc and aluminum and acids such as salicylic acid and alkyl salicylic acid, metal salts and metal complexes of benzyl acid, amide compounds, phenol compounds, naphthol compounds, phenol amide compounds and the like are preferably used. Polymers that exert the negative chargeability, such as sulfonates, carboxylates and halogens, may also be used.

With respect to the used amount of the charge controlling agent, not particularly limited, any amount may be used as long as the content of the charge controlling agent in the toner is set within the following range.

For example, in the case of adding the agent in resin particles of each of the above-mentioned structures (1-1) to (1-6), the used amount is set so that the content of the charge controlling agent is not more than 35% by weight, preferably in a range from 1 to 9% by weight, with respect to the entire resin particles.

For example, in the case of adding the agent in resin particles of the above-mentioned structures (2-1) to (2-6), the used amount is set so that the content of the charge controlling agent is not more than 31% by weight, preferably in a range from 1 to 8% by weight, with respect to the entire resin particles.

For example, in the case of containing the colorant in resin particles of the above-mentioned structures (3-1) to (3-6), the used amount is set so that the content of the charge controlling agent is not more than 13% by weight, preferably in a range from 1 to 3% by weight, with respect to the entire resin particles.

With respect to the wax, various known waxes are proposed. Specific examples of the wax include: olefin-based waxes such as low-molecular-weight polyethylene, low-molecular-weight polypropylene, copolymer polyethylene, grafted polyethylene and grafted polypropylene; ester-based waxes having a long-chain aliphatic group such as behenyl behenate, montanate and stearyl stearate; plant-based waxes such as hydrogenated castor oil and carnauba wax; ketones having a long-chain alkyl group such as distearyl ketone; silicone-based waxes having an alkyl group or a phenyl group; higher fatty acid such as stearic acid; higher fatty acid amides such as oleic acid amide and stearic acid amide; long-chain fatty acid alcohols; long-chain fatty acid polyhydroxy alcohols such as pentaerythritol and partial esters thereof; paraffin-based waxes; and Fischer-Tropsch wax.

With respect to preferable waxes to be added to the toner of the present invention, those composed of a crystalline ester compound represented by the following formula (1) (hereinafter, referred to as "specific ester compound") can be proposed.

$$R^1—(OCO—R^2)n \qquad \text{Formula (1)}$$

(in the formula, each of $R^1$ and $R^2$ independently represents a hydrocarbon group having 1 to 40 carbon atoms, which may have a substituent, and n is an integer of 1 to 4.)

In formula (1) representing the specific ester compound, each of $R^1$ and $R^2$ represents a hydrocarbon group that may have a substituent. The hydrocarbon group $R^1$ has 1 to 40 carbon atoms, preferably 1 to 20, more preferably 2 to 5. The hydrocarbon group $R^2$ has 1 to 40 carbon atoms, preferably 16 to 30, more preferably 18 to 26. In formula (1), n is an integer of 1 to 4, preferably 2 to 4, more preferably 3 and 4, most preferably 4. The specific ester compound is preferably synthesized through a dehydration condensing reaction between alcohol and carboxylic acid.

With respect to specific examples of the specific ester compound, the following compounds represented by the respective formulas (1w) to (22w) are proposed:

$$CH_3—(CH_2)_{12}—COO—(CH_2)_{17}—CH_3 \qquad (1w)$$

$$CH_3—(CH_2)_{18}—COO—(CH_2)_{17}—CH_3 \qquad (2w)$$

$$CH_3—(CH_2)_{20}—COO—(CH_2)_{21}—CH_3 \qquad (3w)$$

$$CH_3—(CH_2)_{14}—COO—(CH_2)_{19}—CH_3 \qquad (4w)$$

$$CH_3—(CH_2)_{20}—COO—(CH_2)_6—O—CO—(CH_2)_{20}—CH_3 \qquad (5w)$$

(6w) $CH_3-(CH_2)_{20}-COO-(CH_2)_2-CH(CH_3)-CH_2-O-CO-(CH_2)_{20}-CH_3$ (7w) $CH_3-(CH_2)_{22}-COO-(CH_2)_2-CH(CH_3)-CH_2-O-CO-(CH_2)_{22}-CH_3$ (8w) $CH_3-(CH_2)_{22}-COO-(CH_2)_2-C(CH_3)_2-CH_2-O-CO-(CH_2)_{22}-CH_3$ (9w) $CH_3-(CH_2)_{26}-COO-(CH_2)_2-C(CH_3)_2-CH_2-O-CO-(CH_2)_{26}-CH_3$ (10w) $CH(CH_2-O-CO-(CH_2)_{26}-CH_3)_3$ (11w) $CH(CH_2-O-CO-(CH_2)_{22}-CH_3)_3$ (12w) $CH(CH_2-OH)(CH_2-O-CO-(CH_2)_{26}-CH_3)_2$ (13w) $CH(CH_2-OH)(CH_2-O-CO-(CH_2)_{22}-CH_3)_2$ (14w) $CH(CH_2-OH)(OH)(CH_2-O-CO-(CH_2)_{26}-CH_3)$ (15w) $CH(CH_2-OH)(OH)(CH_2-O-CO-(CH_2)_{22}-CH_3)$ (16w) $CH_3-(CH_2)_{26}-COO-CH_2-C(CH_3)(CH_2-O-CO-(CH_2)_{26}-CH_3)-CH_2-O-CO-(CH_2)_{26}-CH_3$ (17w) $CH_3-(CH_2)_{20}-COO-CH_2-C(CH_2CH_3)(CH_2-O-CO-(CH_2)_{20}-CH_3)-CH_2-O-CO-(CH_2)_{20}-CH_3$ (18w) $CH_3-(CH_2)_{26}-COO-CH_2-C(CH_2-O-CO-(CH_2)_{26}-CH_3)_2-CH_2-O-CO-(CH_2)_{26}-CH_3$ (19w) $CH_3-(CH_2)_{20}-COO-CH_2-C(CH_2-O-CO-(CH_2)_{20}-CH_3)_2-CH_2-O-CO-(CH_2)_{20}-CH_3$ (20w) $CH_3-(CH_2)_{18}-COO-CH_2-C(CH_2-O-CO-(CH_2)_{18}-CH_3)_2-CH_2-O-CO-(CH_2)_{18}-CH_3$

-continued (21w) $CH_3-(CH_2)_{16}-COO-CH_2-C(CH_2-O-CO-(CH_2)_{16}-CH_3)_3$ (22w) $CH_3-(CH_2)_{20}-COO-CH_2-C(CH_2-O-CO-CH_3)_3$ Among these waxes, those which are preferably used for improving the low-temperature fixing property are waxes having a melting point of not more than 100° C., preferably in a range from 50 to 100° C., more preferably from 55 to 90° C. The melting point exceeding 100° C. fails to provide sufficient effects for reducing the fixing temperature.

With respect to the used amount of the wax, not particularly limited, any amount may be used as long as the content of the wax in the toner is set within the following range.

For example, in the case of adding the wax in resin particles of each of the above-mentioned structures (1-1) to (1-6), the used amount is set so that the content of the wax is in a range from 10 to 35% by weight, with respect to the entire resin particles.

For example, in the case of adding the wax in resin particles of the above-mentioned structures (2-1) to (2-6), the used amount is set so that the content of the wax is in a range of 10 to 31% by weight with respect to the entire resin particles.

For example, in the case of adding the wax in resin particles of the above-mentioned structures (3-1) to (3-6), the used amount is set so that the content of the wax is in a range from 10 to 20% by weight, with respect to the entire resin particles.

With respect to the method for adding the wax to the toner, a method in which the wax is dissolved in a polymerization composition at the time of the above-mentioned miniemulsion polymerizing process to be emulsion-dispersed in the aqueous solvent so that the miniemulsion polymerization is carried out is preferably used; alternatively, a method in which upon forming the above-mentioned resin particles, wax particles are used as seeds so that a seed polymerizing process is carried out, or a method in which the wax is subjected to aggregating/fusing processes together with the resin particles in the aggregating/fusing processes that will be described later, may be used.

In any of the above-mentioned structures of the resin particles, the particle diameter of the resin particles is normally set in a range of 50 to 300 nm in the volume-average particle size.

The toner particles forming the toner of the present invention are formed by aggregating/fusing at least resin particles to one another in an aqueous medium through a salting-out process. With respect to the resin particles to be subjected to the aggregating/fusing processes, one kind of the above-mentioned resin particles may be used, or two or more kinds of them may be used. In addition to the above-mentioned resin particles, another kind of resin particles may be used in combination, within a range in which the effects of the present are obtained. With respect to another kind of resin particles, the same kind of resin particles are used except that they include neither colorant particles nor charge-controlling agent particles. In the present invention, toner constituent particles, such as colorant agent particles, charge-controlling agent particles and wax particles, may be added to an aqueous medium to be subjected to the aggregating/fusing processes together with the resin particles, as long as the resin particles that contain at least either the colorant agent particles or the charge-controlling agent particles through the miniemulsion polymerization are used. In the case when the toner component particles are added to an aqueous medium to be subjected to aggregating/fusing processes together with the resin particles, the toner component particles are preferably dissolved in water in the presence of the above-mentioned surfactant, and used as a dispersion solution. The toner component dispersion solution is preferably set to have a dispersion particle size of not more than 1 μm, preferably in a range of 100 to 500 nm. In particular, the wax dispersion solution may be prepared by using any one of conventionally known methods using emulsifying/dispersing devices and the like as described in, for example, "Emulsifying/dispersing technique and particle-diameter control of polymer fine particles Chapter 3" in Reaction Engineering Seminar Report 1 issued by Polymer Society in March, 1995.

Figure 2:
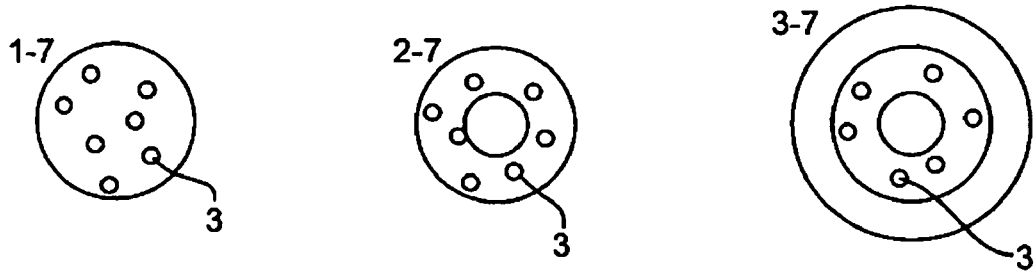
FIG. 2 shows schematic sectional views of resin particles used in Comparative Examples.

With respect to applicable combinations of resin particles and/or dispersion solutions in the present invention, the following combinations (I) to (XV) are listed. Here, as shown in FIG. 2 respectively, these resin particles (1-7), (2-7) and (3-7) are the same as the above-mentioned resin particles (1-1), (2-1) and (3-1), except that wax is used instead of the colorant.

(I) resin particles (1-1), (2-1) or (3-1)—resin particles (1-7), (2-7) or (3-7);

(II) resin particles (1-1), (2-1) or (3-1)—wax dispersion solution;

(III) resin particles (1-4), (2-4) or (3-4) (used singly);

(IV) resin particles (1-6), (2-6) or (3-6) (used singly);

(V) resin particles (1-2), (2-2) or (3-2)—resin particles (1-4), (2-4) or (3-4);

(VI) resin particles (1-3), (2-3) or (3-3)—resin particles (1-7), (2-7) or (3-7);

(VII) resin particles (1-3), (2-3) or (3-3)—wax dispersion solution;

(VIII) resin particles (1-4), (2-4) or (3-4)—charge-controlling agent dispersion solution;

(IX) resin particles (1-4), (2-4) or (3-4)—resin particles (1-2), (2-2) or (3-2);

(X) resin particles (1-5), (2-5) or (3-5)—colorant dispersion solution;

(XI) resin particles (1-5), (2-5) or (3-5)—resin particles (1-1), (2-1) or (3-1);

(XII) resin particles (1-1), (2-1) or (3-1)—resin particles (1-7), (2-7) or (3-7)—charge-controlling agent dispersion solution;

(XIII) resin particles (1-1), (2-1) or (3-1)—wax dispersion solution—charge-controlling agent dispersion solution;

(XIV) resin particles (1-1), (2-1) or (3-1)—resin particles (1-7), (2-7) or (3-7)—resin particles (1-2), (2-2) or (3-2);

(XV) resin particles (1-1), (2-1) or (3-1)—wax dispersion solution—resin particles (1-2), (2-2) or (3-2).

Among the above-mentioned combinations, combinations (I), (II), (III) and (IV) are preferably used.

In the case when, among the above-mentioned combinations, the combination using resin particles to which colorant particles are added through the miniemulsion polymerization method is adopted, since the colorant particles are uniformly dispersed in the toner particles, it is possible to ensure sufficient image density even in the case of a low content. Since the colorant agent particles are effectively dispersed with a high content without causing separation of the colorant, it becomes possible to further improve the image density.

In the case when, among the above-mentioned combinations, the combination using resin particles to which charge-controlling agent particles are added through the miniemulsion polymerization method is adopted, since the charge-controlling agent particles are uniformly dispersed in the toner particles, it is possible to ensure sufficient charging stability even in the case of a low content. Since the charge-controlling agent particles are effectively dispersed with a high content without causing separation of the charge-controlling agent, it becomes possible to further improve the charging stability.

In the case when, among the above-mentioned combinations, the combination in which one or two or more kinds of resin particles to which colorant particles and charge-controlling agent particles are added simultaneously or in a separate manner through a miniemulsion polymerization method is adopted, since the colorant particles and the charge-controlling agent particles are uniformly dispersed in the toner particles, it is possible to simultaneously ensure sufficient image density and charging stability even in the case of comparatively low contents of these particles. Since the colorant particles and the charge-controlling agent particles are effectively dispersed with high contents without causing separation of the colorant and the charge-controlling agent, it becomes possible to further improve the image density and the charging stability.

The rate of used amounts of the resin particles and/or the dispersion solution is not particularly limited as long as the amounts of the respective toner components contained in the toner are set in the following ranges.

The salting-out treatment, which is described in various documents and books concerning colloid as well as in Chapter 6 and thereafter of "Chemistry of Polymer Latex" written by Sohichi Muroi, in detail, is a method in which electric double layers of dispersed particles in a solvent are compressed so as to allow the particles to aggregate with one another. In the present invention, a flocculant is normally used so as to carry out the "salting-out" process.

With respect to the flocculant, in addition to a surfactant having a reversed polarity to the polarity of a polar functional group of the resin particles as well as to the polarity of a surfactant to be used as a dispersion solution such as colorant particles to be aggregated together with the resin particle dispersion solution and the resin particles, a divalent or more inorganic metal salt is preferably used. In general, the higher the number of valence, the higher the aggregating force becomes; therefore, the flocculant is properly selected by taking the aggregating speed and the stability of the manufacturing process into consideration. Specific examples of the flocculant include: metal salts, such as calcium chloride, calcium nitrate, barium chloride, magnesium chloride, zinc chloride, aluminum chloride and aluminum sulfate; and inorganic metal salt copolymers, such as aluminum polychloride, aluminum polyhydroxide and calcium polysulfide.

In general, upon adding the flocculant, the temperature of the dispersion system is preferably maintained below 40° C. in order to suppress an abrupt aggregation inside the system. When the flocculant is added under a condition exceeding 40° C., an abrupt aggregation tends to occur, making the particle size control difficult, as well as causing a problem of low bulk density of the resulting particles. Thereafter, in general, this is heated to allow the aggregating and fusing processes of the particles to progress simultaneously; thus, fused particles (toner particles) are formed. With respect to the stirring process, conventionally known stirring devices, such as a reaction vessel having paddle blades, anchor blades, triple sweptback blades, max blend blades, double helical blades and the like, may be used, or devices such as a homogenizer, a homomixer and a Henschel mixer may be used. The number of revolutions in the stirring process is preferably set so as to maintain the system in a turbulent flow state.

The particle size growth through the aggregation (salting-out reaction) is comparatively easily controlled by adjusting the pH and the temperature of the dispersion solution. The pH value is not univocally defined since the value varies depending on ZETA potential and equipotential points of the reaction system, as well as on the kinds and amounts of the flocculant to be used, the kinds and amounts of the surfactant and the particle sizes of the target toner; however, for example, in the case when an aluminum-based flocculant is used, the pH value is set in a range of 2 to 6, and in the case of a magnesium-based flocculant, the pH value is set in a range of 7 to 12, in order to effectively exert the salting-out function.

In the same manner as the pH, although not univocally defined, the reaction temperature is preferably set to a condition in which the particle size growth is controlled within a range of 40 to 95° C. At a temperature higher than this range, the shape of the toner particle tends to become virtually a true spherical shape due to the simultaneous progresses of the aggregating and fusing processes, causing insufficient shape-controlling property. The reaction is maintained for at least not less than 10 minutes at a predetermined temperature, preferably for at least not less than 20 minutes, so that toner particles having a predetermined particle size are obtained. The reaction temperature lower than Tg of the resin only allows the particles to aggregate, and fails to allow the fusing process to progress, while the reaction temperature higher than Tg allows the aggregating and fusing processes to progress simultaneously. In the case of a slow fusing process, the fusing process may be carried out by raising the temperature after the aggregating process.

In the aggregating/fusing processes, the heating process may be carried out to a predetermined temperature at a constant temperature-rise rate, or may be carried out step by step. The number of revolutions of the stirring blades may be appropriately adjusted.

With respect to the aggregating rate and particle-size control, these controlling operations are carried out by controlling the reaction temperature and the number of revolutions in the stirring process, while monitoring the aggregating state of the particles inside the system by using a microscope and a particle-size measuring device, until the particles have reached a predetermined particle size. When the particles have reached the predetermined particle size, an operation for lowering the aggregating force is carry out so as to stop the particle growth in the system or to delay the growth rate thereof.

With respect to the means for lowering the aggregating force, a means for increasing the stability of the particles or a means for lowering the aggregating function of the flocculant may be used. For example, with respect to the means for increasing the stability of the particles, a method for adjusting the pH of the system toward the stable side (for example, when aggregation is made under an acidic system, an adjustment is carried out from the neutral side toward the alkali side, and when aggregation is made under an alkali system, the adjustment is carried out from the neutral side toward the acidic side) and a method for adding the above-mentioned surfactant and the like may be used. With respect to the means for lowering the aggregating function of the flocculant, metal cations having different numbers of valence may be added so that the aggregating force is greatly lowered due to the antagonistic action thereof. After the aggregating force has been lowered, the system is heated to accelerate the fusing process and also to control the shape toward the spherical-shape side.

In the present invention, the fused particles obtained through the above-mentioned method may be used as toner particles, or the fused particles are used as core particles, with the shell layer being formed on the surface of the core particles, so that toner particles may be formed. The shell layer can be formed by allowing the shell particles to adhere/fuse to the surface of the core particles in an aqueous medium so that the core particles are allowed to grow. The term "adhesion/fusion" indicates the fact that adhering and fusing processes are carried out simultaneously or step by step, or the action that allows the adhering and fusing processes to take plate simultaneously or step by step.

With respect to the shell particles, the above-mentioned resin particles and colorant particles containing at least either the colorant particles or the charge-controlling agent particles can be used, and when, among those resin particles, the resin particles containing the charge-controlling agent (for example, the above-mentioned resin particles (1-2), (2-2), (3-2), (1-3), (2-3), (3-3), (1-5), (2-5), (3-5), etc.) are used, the charge-controlling agent is allowed to exist only in the vicinity of the toner surface so that the charging quantity fluctuation width is made smaller by using a lower content of the charge-controlling agent; thus, it becomes possible to obtain toner that is stable against environmental fluctuations.

In order to allow the shell particles to adhere/fuse onto the surface of the core particles, this shell layer forming process is preferably carried out in succession to the afore-mentioned aggregating/fusing processes used for obtaining the core particles (fused particles). In other words, a dispersion solution of shell particles is added to the dispersion solution of core particles obtained through the adhering/fusing processes of the resin particles. In this case, in order to allow the core particles to properly grow through the adhering/fusing processes of the shell particles, the corresponding reaction temperature is preferably set to the reaction temperature at which the desired particle size has been obtained in the aggregating/fusing processes or a temperature not less than this temperature. In the case when the shell particles do not adhere to the core particles properly, the coagulant, used in the aggregating/fusing processes, may be further added on demand so as to increase the aggregating force and allow the adhesion.

The toner particles, obtained as described above, have a volume-average particle size of 3 to 10 μm, preferably 4 to 7 μm, and are effectively used as the next generation high-resolution toner particles.

The resulting toner particles are normally subjected to a washing process, a drying process and an external additive applying process.

The washing process includes a filtering treatment which filters toner particles from a dispersion solution of the resulting toner particles and a washing treatment which removes adhering matters such as surfactants and flocculants from the toner particles (cake-shaped aggregate) that have been filtered and separated. Here, with respect to the washing means for washing the filtered toner particles, conventionally known methods are used; and for example, a method in which the toner particles that have been filtered and separated are formed into a slurry, and stirred with pure water in a container equipped with a stirring device, and a method in which pure water is applied thereon while the toner particles are being filtered under reduced pressure or filtered through a centrifugal separator are used. In this case, prior to washing with pure water, the toner particles may be preliminarily subjected to an acidic or an alkali treatment, in order to elute/remove surfactants and metal salts that remain in the toner particles.

In the drying process, normally, the toner particles are dried until the moisture of the toner particles has been reduced to not more than 1% by weight, preferably not more than 0.6% by weight.

In the external additive applying process, a single kind or a plurality of kinds of external additive agents are added to and mixed with the toner particles that have been dried, to obtain a toner. With respect to the external additive agents, various inorganic oxide fine particles, such as silica, alumina, titania, strontium titanate and cerium oxide, fine particles that have been subjected to a hydrophobicity-applying treatment, vinyl-based monomers and metal soups, such as zinc stearate and calcium stearate, may be used. In particular, in full-color toners that are subjected to complex processes, it is desirable to add functional particles that can further improve the fluidity, chargeability, transferring property and cleaning property thereto. The added amount of the external additive agents is preferably set in a range from 0.05 to 5 parts by weight with respect to the toner particles.

The toner of the present invention may be used as any of negatively chargeable toners and positively chargeable toners.

The toner of the present invention is used as a magnetic or non-magnetic mono-component developer or two-component developer. In the case when the toner of the present invention is mixed with carrier particles, and used as a two-component developer, the carrier particles can be made from conventionally known materials such as metals like iron, ferrite and magnetite, and alloys between these metals and metals such as aluminum and lead.

In the case when, upon manufacturing the toner of the present invention, resin particles to which colorant particles are added through the miniemulsion polymerization method are used, the colorant particles are contained in the toner, with an average dispersion particle size of not more than 200 nm, particularly in a range of 30 to 200 nm, preferably 50 to 160 nm, more preferably 70 to 150 nm. Consequently, with respect to the transmission density of an image having a toner adhesion amount of 3.5 g/m$^2$, it is possible to achieve a value of not less than 0.9, particularly not less than 1.2, preferably not less than 1.5, in the case of cyan, magenta or yellow toner, and it is also possible to achieve a value of not less than 1.2, particularly not less than 1.4, preferably 1.6, in the case of black toner.

In the case when, upon manufacturing the toner of the present invention, resin particles to which charge-controlling agent particles are added through the miniemulsion polymerization method are used, the charge-controlling agent particles are contained in the toner, with an average dispersion particle size of not more than 300 nm, particularly, in a range of 80 to 300 nm, preferably 100 to 250 nm, more preferably 100 to 220 nm. Consequently, with respect to the charging quantity fluctuation width caused when the toner is left under L/L environment (10° C., 15% RH) and H/H environment (30° C., 85% RH), it is possible to achieve a value of not more than 35 μC/g, preferably 30 μC/g.

In the case when, upon manufacturing the toner of the present invention, resin particles to which colorant particles and charge-controlling particles are added through the miniemulsion polymerization method simultaneously or separately, it is possible to respectively achieve the above-mentioned average dispersion particle sizes of the colorant particles and the charge-controlling agent particles. Consequently, it becomes possible to simultaneously achieve the above-mentioned transmission density and charging quantity fluctuation width.

In the toner of the present invention, the colorant particles are preferably contained in the toner particles at not less than 2% by weight, preferably at not less than 2.5% by weight.

The charge-controlling agent is not necessarily contained; however, when it is contained, the content is preferably set to not less than 0.5% by weight, more preferably not less than 1% by weight, with respect to the entire toner particles.

With respect to the wax, the content is preferably set to not less than 7% by weight, more preferably not less than 10% by weight.

EXAMPLES

The following description will discuss examples of the present invention in more detail; however, the present invention is not intended to be limited thereby. Here, in the following description, the term "parts" refers to "parts by weight".

<Formation of Resin Particles>

(Latex particles 1-1C) Miniemulsion Polymerization (Monomer Solution 1)

| | |
|---|---|
| Styrene | 123.81 g |
| n-butyl acrylate | 39.51 g |
| Methacrylic acid | 12.29 g |
| n-octyl mercaptan | 0.72 g |
| C.I. Pigment Blue 15:3 | 30 g |

The above-mentioned monomer solution 1 was loaded into a flask equipped with a stirring device, and heated to 80° C. to be dissolved and dispersed therein so that a monomer solution was prepared.

(Dispersion Medium 1)

| | |
|---|---|
| $C_{10}H_{21}(OCH_2CH_2)_2OSO_3Na$ | 0.60 g |
| Ion exchanged water | 1000.00 g |

The above-mentioned dispersion medium 1 was heated to 80° C. in a mayonnaise bottle (1.8 L), and to this was added the above-mentioned monomer solution 1, and this was mixed and dispersed for one hour at 80° C. by using a mechanical dispersing machine "CLEARMIX" having a circulation path (made by M Technique) to prepare a dispersion solution (emulsion solution). Successively, the above-mentioned dispersion solution (miniemulsion) was added to a separable flask (5000 ml) equipped with a stirring device, a temperature sensor, a cooling tube and a nitrogen-introducing device, and this was stirred at a stirring speed of 230 rpm under a nitrogen gas flow to prepare a mixed solution having a solution temperature of 82° C. in the flask.

To this mixed solution was added an initiator solution prepared by dissolving 6.12 g of a polymerization initiator (potassium persulfate) in 250 ml of ion exchanged water, and this system was heated while being stirred at 82° C. for 1 to 2 hours to carry out a polymerization process; thereafter, this was cooled to 28° C. to prepare latex particles (1-1C) (dispersion solution of resin particles, which contains colorant particles). The resin particles (1-1C) constituting this latex have a weight-average molecular weight of 50,000 and a volume-average particle size of 120 nm.

(Latex Particles 1-1M, 1-1Y and 1-1K) Miniemulsion Polymerization

The same method as the manufacturing method of latex particles 1-1C was used except that, instead of C.I. Pigment Blue 15:3, each of C.I. Pigment Red 122, C.I. Pigment Yellow 74 and carbon black (Mogul L) was used to prepare latex particles 1-1M, 1-1Y and 1-1K.

(Latex Particles 1-2) Miniemulsion Polymerization

The same method as the manufacturing method of latex particles 1-1C was carried out except that, instead of C.I. Pigment Blue 15:3, 15.0 g of a charge-controlling agent represented by the formula (I) below to prepare latex particles 1-2.

(I)

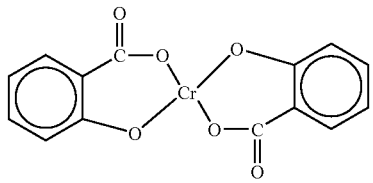

(Latex Particles 1-3C, 1-3M, 1-3Y, 1-3K) Miniemulsion Polymerization

The same method as each of the manufacturing methods of latex particles 1-1C, 1-1M, 1-1Y and 1-1K was carried out except that 15.0 g of a charge-controlling agent represented by the following formula (I) together with a colorant to prepare latex particles 1-3C, 1-3M, 1-3Y and 1-3K.

(Latex Particles 1-4C, 1-4M, 1-4Y, 1-4K) Miniemulsion Polymerization

The same method as each of the manufacturing methods of latex particles 1-1C, 1-1M, 1-1Y and 1-1K was carried out except that 94 g of a wax WEP-5 (made by Nippon Oil & Fats Co., Ltd.) was used together with a colorant to prepare latex particles 1-4C, 1-4M, 1-4Y and 1-4K.

(Latex Particles 1-5) Miniemulsion Polymerization

The same method as the manufacturing method of latex particles 1-1C was carried out except that, instead of C.I. Pigment Blue 15:3, 15.0 g of the charge-controlling agent represented by the above-mentioned formula (I) and 94 g of wax WEP-5 were used to obtain latex particles 1-5.

(Latex Particles 1-6C, 1-6M, 1-6Y, 1-6K) Miniemulsion Polymerization

The same method as each of the manufacturing methods of latex particles 1-1C, 1-1M, 1-1Y and 1-1K was carried out except that 15 g of the charge-controlling agent represented by the above-mentioned formula (I) and 94 g of wax WEP-5 were used together with a colorant to prepare latex particles 1-6C, 1-6M, 1-6Y and 1-6K.

(Latex Particles 2-1C)

(1) Formation of Core Particles (First-stage Polymerization)

(Dispersion Medium 1)

| | |
|---|---|
| Sodium dodecyl sulfate | 4.05 g |
| Ion exchanged water | 2500.00 g |

Successively, the above-mentioned dispersion medium 1 was loaded into a separable flask (5000 ml) equipped with a stirring device, a temperature sensor, a cooling tube and a nitrogen-introducing device, and the temperature inside the flask was raised to 80° C., while this was stirred at a stirring speed of 230 rpm under a nitrogen gas flow.

(Monomer Solution 1)

| | |
|---|---|
| Styrene | 568.00 g |
| n-butyl acrylate | 164.00 g |
| Methacrylic acid | 68.00 g |
| n-octyl mercaptan | 16.51 g |

To this active agent solution was added an initiator solution prepared by dissolving 9.62 g of a polymerization initiator (potassium persulfate) in 200 g of ion exchanged water, and to this was dripped the above-mentioned monomer solution 1 in 90 minutes, and this system was heated at 80° C. for 2 hours while being stirred to carry out a polymerization process (first-stage polymerization); thus, a latex was prepared. This is referred to as "latex (2H)". The weight-average particle size of the latex (2H ) was 68 nm.

(2) Formation of Functional Layer (Second-stage Polymerization (Miniemulsion Polymerization));

(Monomer Solution 2)

| | |
|---|---|
| Styrene | 123.81 g |
| n-butyl acrylate | 39.51 g |
| Methacrylic acid | 12.29 g |
| n-octyl mercaptan | 0.72 g |
| C.I. Pigment Blue 15:3 | 30 g |

The above-mentioned monomer solution 2 was loaded into a flask equipped with a stirring device, and heated to 80° C. to be dissolved and dispersed therein so that a monomer solution was prepared.

(Dispersion Medium 2)

| | |
|---|---|
| $C_{10}H_{21}(OCH_2CH_2)_2OSO_3Na$ | 0.60 g |
| Ion exchanged water | 1000.00 g |

The above-mentioned dispersion medium 2 was heated to 80° C. in a mayonnaise bottle (1.8 L), and to this was added the above-mentioned monomer solution 2, and this was mixed and dispersed for one hour at 80° C. by using a mechanical dispersing machine "CLEARMIX" having a circulation path (made by M Technique) to prepare a dispersion solution (miniemulsion). To a separable flask (5000 ml) equipped with a stirring device, a temperature sensor, a cooling tube and a nitrogen-introducing device was loaded an emulsion solution of 80° C. consisting of 140 g of the latex (2H ) and 1700 g of ion exchanged water, and to this was further added the above-mentioned dispersion solution (miniemulsion) immediately after the preparation thereof, and this was stirred at a stirring speed of 230 rpm under a nitrogen gas flow to prepare a mixed solution having a solution temperature of 82° C. in the flask.

To this mixed solution was added an initiator solution prepared by dissolving 6.12 g of a polymerization initiator (potassium persulfate) in 250 ml of ion exchanged water, and this system was heated while being stirred at 82° C. for 1 to 2 hours to carry out a polymerization process (second-stage polymerization); thus, a dispersion solution of composite resin particles each of which has a structure in which the surface of the latex (2H ) particle is coated with a film was obtained. This was cooled to 28° C. to prepare a dispersion solution of composite resin particles (2-1C) which has a center portion made of the latex (2H ) and a functional layer made of the second-stage polymerization resin, with C.I. Pigment Blue 15:3 being contained in the functional layer. The weight-average molecular weight of this latex particles (2-1C) was 50,000 and the volume-average particle size thereof was 180 nm.

(Latex Particles 2-1M, 2-1Y and 2-1K) Second-stage Polymerization

The same method as the manufacturing method of latex particles 2-1C was used except that, instead of C.I. Pigment Blue 15:3, each of C.I. Pigment Red 122, C.I. Pigment Yellow 74 and carbon black (Mogul L) was used to prepare latex particles 2-1M, 2-1Y and 2-1K.

(Latex Particles 2-2) Second-stage Polymerization

The same method as the manufacturing method of latex particles 2-1C was carried out except that, instead of C.I. Pigment Blue 15:3, 15.0 g of a charge-controlling agent represented by the above-mentioned formula (I) to prepare latex particles 2-2.

(Latex Particles 2-3C, 2-3M, 2-3Y, 2-3K) Second-stage Polymerization

The same method as each of the manufacturing methods of latex particles 2-1C, 2-1M, 2-1Y and 2-1K was carried out except that 15.0 g of a charge-controlling agent represented by the above formula (I) together with a colorant to prepare latex particles 2-3C, 2-3M, 2-3Y and 2-3K, respectively.

(Latex Particles 2-4C, 2-4M, 2-4Y, 2-4K) Second-stage Polymerization

The same method as each of the manufacturing methods of latex particles 2-1C, 2-1M, 2-1Y and 2-1K was carried out except that 94 g of wax WEP-5 was used together with a colorant to prepare latex particles 2-4C, 2-4M, 2-4Y and 2-4K.

(Latex Particles 2-5) Second-stage Polymerization

The same method as the manufacturing method of latex particles 2-1C was carried out except that, instead of C.I. Pigment Blue 15:3, 15.0 g of the charge-controlling agent represented by the above-mentioned formula (I) and 94 g of wax WEP-5 were used to obtain latex particles 2-5.

(Latex Particles 2-6C, 2-6M, 2-6Y, 2-6K) Second-stage Polymerization

The same method as each of the manufacturing methods of latex particles 2-1C, 2-1M, 2-1Y and 2-1K was carried out except that 15.0 g of the charge-controlling agent represented by the above-mentioned formula (I) and 94 g of wax WEP-5 were used together with a colorant to prepare latex particles 2-6C, 2-6M, 2-6Y and 2-6K.

(Latex Particles 3-1C)

(1) Formation of Core Particles (First-stage Polymerization)

(Dispersion Medium 1)

| | |
|---|---|
| Sodium dodecyl sulfate | 4.05 g |
| Ion exchanged water | 2500.00 g |

The above-mentioned dispersion medium 1 was loaded into a separable flask (5000 ml) equipped with a stirring device, a temperature sensor, a cooling tube and a nitrogen-introducing device, and the temperature inside the flask was raised to 80° C., while this was stirred at a stirring speed of 230 rpm under a nitrogen gas flow.

(Monomer Solution 1)

| | |
|---|---|
| Styrene | 568.00 g |
| n-butyl acrylate | 164.00 g |
| Methacrylic acid | 68.00 g |
| n-octyl mercaptan | 16.51 g |

To this active agent solution was added an initiator solution prepared by dissolving 9.62 g of a polymerization initiator (potassium persulfate) in 200 g of ion exchanged water, and to this was dripped the above-mentioned monomer solution in 90 minutes, and this system was heated at 80° C. for 2 hours while being stirred to carry out a polymerization process (first-stage polymerization); thus, a latex was prepared. This is referred to as "latex (1H)". The weight-average particle size of the latex (1H ) was 68 nm.

(2) Formation of Functional Layer (Second-stage Polymerization (Miniemulsion Polymerization));

(Monomer Solution 2)

| | |
|---|---|
| Styrene | 123.81 g |
| n-butyl acrylate | 39.51 g |
| Methacrylic acid | 12.29 g |
| n-octyl mercaptan | 0.72 g |
| C.I. Pigment Blue 15:3 | 30 g |

The above-mentioned monomer solution 2 was loaded into a flask equipped with a stirring device, and heated to 80° C. to be dissolved and dispersed therein so that a monomer solution was prepared.

(Dispersion Medium 2)

| | |
|---|---|
| $C_{10}H_{21}(OCH_2CH_2)_2OSO_3Na$ | 0.60 g |
| Ion exchanged water | 1000.00 g |

The above-mentioned dispersion medium 2 was heated to 80° C. in a mayonnaise bottle (1.8 L), and to this was added the above-mentioned monomer solution 2, and this was mixed and dispersed for one hour at 80° C. by using a mechanical dispersing machine "CLEARMIX" having a circulation path (made by M Technique) to prepare a dispersion solution (miniemulsion). To a separable flask (5000 ml) equipped with a stirring device, a temperature sensor, a cooling tube and a nitrogen-introducing device was loaded an emulsion solution consisting of 140 g of the latex (1H ) and 1700 g of ion exchanged water of 80° C., and to this was further added the above-mentioned dispersion solution (miniemulsion) immediately after the preparation thereof, and this was stirred at a stirring speed of 230 rpm under a nitrogen gas flow to prepare a mixed solution having a solution temperature of 82° C. in the flask.

To this mixed solution was added an initiator solution prepared by dissolving 6.12 g of a polymerization initiator (potassium persulfate) in 250 ml of ion exchanged water, and this system was heated while being stirred at 82° C. for 1 to 2 hours to carry out a polymerization process (second-stage polymerization); thus, a dispersion solution of composite resin particles each of which had a structure in which the surface of the latex (1H ) particle was coated with a film was obtained. This solution is referred to as "latex (1HM)". Here, this 1HM latex had a weight-average molecular weight of 50,000.

(3) Formation of Outer Layer (Third-stage Polymerization)

(Monomer Solution 3)

| | |
|---|---|
| Styrene | 343.64 g |
| n-butyl acrylate | 59.40 g |
| n-octyl mercaptan | 5.97 g |

To the latex (1HM) obtained as described above was added an initiator solution prepared by dissolving 8.3 g of a polymerization initiator (KPS) in 350 ml of ion exchanged water, and to this was dripped the above-mentioned monomer solution 3 while being heated and stirred, under a temperature condition of 82° C. in one hour. After the dripping process, this was heated and stirred for 2 hours to carry out a polymerization process (third-stage polymerization), and then cooled to 28° C. to prepare a latex dispersion solution of composite resin particles, each of which has a center portion made from the latex (1H ), a functional layer made from the second-stage polymerization resin and an outer layer made from the third-stage polymerization resin, with C.I. Pigment Blue 15:3 being contained in the second-stage polymerization resin. These latex particles 3-1C had a main peak molecular weight at 18,000 with respect to the THF soluble component, and the volume-average particle size of these resin particles was 230 nm.

(Latex Particles 3-1M, 3-1Y and 3-1K) Third-stage Polymerization

The same method as the manufacturing method of latex particles 3-1C was carried out except that, instead of C.I. Pigment Blue 15:3, each of C.I. Pigment Red 122, C.I. Pigment Yellow 74 and carbon black (Mogul L) was used to prepare latex particles 3-1M, 3-1Y and 3-1K.

(Latex Particles 3-2) Third-stage Polymerization

The same method as the manufacturing method of latex particles 3-1C was carried out except that, instead of C.I.

Pigment Blue 15:3, 15.0 g of a charge-controlling agent represented by the above-mentioned formula (I) was used to prepare latex particles 3-2.

(Latex Particles 3-3C, 3-3M, 3-3Y, 3-3K) Third-stage Polymerization

The same method as each of the manufacturing methods of latex particles 3-1C, 3-1M, 3-1Y and 3-1K was carried out except that 15.0 g of a charge-controlling agent represented by the above formula (I) was used together with a colorant to prepare latex particles 3-3C, 3-3M, 3-3Y and 3-3K, respectively.

(Latex Particles 3-4C, 3-4M, 3-4Y, 3-4K) Third-stage Polymerization

The same method as each of the manufacturing methods of latex particles 3-1C, 3-1M, 3-1Y and 3-1K was carried out except that 94 g of wax WEP-5 was used together with a colorant to prepare latex particles 3-4C, 3-4M, 3-4Y and 3-4K.

(Latex Particles 3-5) Third-stage Polymerization

The same method as the manufacturing method of latex particles 3-1C was carried out except that, instead of C.I. Pigment Blue 15:3, 15.0 g of the charge-controlling agent represented by the above-mentioned formula (I) and 94 g of wax WEP-5 were used to obtain latex particles 3-5.

(Latex Particles 3-6C, 3-6M, 3-6Y, 3-6K) Third-stage Polymerization

The same method as each of the manufacturing methods of latex particles 3-1C, 3-1M, 3-1Y and 3-1K was carried out except that 15 g of the charge-controlling agent represented by the above-mentioned formula (I) and 94 g of wax WEP-5 were used together with a colorant to prepare latex particles 3-6C, 3-6M, 3-6Y and 3-6K.

(Latex Particles 1-7, 2-7, 3-7)

The same method as each of the manufacturing methods of latex particles 1-1C, 2-1C and 3-1C was carried out except that, instead of C.I. Pigment Blue 15:3, 94 g of wax WEP-5 was used to prepare latex particles 1-7, 2-7 and 3-7.

(Latex Particles 1-8, 2-8, 3-8)

The same method as each of the manufacturing methods of latex particles 1-1C, 2-1C and 3-1C was carried out except that C.I. Pigment Blue 15:3 was not used, to obtain latex particles 1-8, 2-8 and 3-8.

TABLE 1

| | | Material added at miniemulsion polymerization | | | | | | | | |
|---|---|---|---|---|---|---|---|---|---|---|
| | | Pigment | | | Charge controlling agent | | | Wax | | |
| Particle structure | Particle | Pigment | Addition amount of pigment | Ratio of pigment in particle | Charge controlling agent | Addition amount of charge controlling agent | Ratio of charge controlling agent in particle | Wax | Addition amount of wax | Ratio of wax in particle |
| 1-1 | 1-1C | C.I. pigment blue 15:3 | 30 g | 14.6% | — | — | — | — | — | — |
| | 1-1M | C.I. pigment red 122 | 30 g | 14.6% | — | — | — | — | — | — |
| | 1-1Y | C.I. pigment yellow 74 | 30 g | 14.6% | — | — | — | — | — | — |
| | 1-1K | Carbon black (Mogul L) | 30 g | 14.6% | — | — | — | — | — | — |
| 1-2 | 1-2 | — | — | — | Charge controlling agent | 15 g | 7.9% | — | — | — |
| 1-3 | 1-3C | C.I. pigment blue 15:3 | 30 g | 13.6% | Charge controlling agent | 15 g | 6.8% | — | — | — |
| | 1-3M | C.I. pigment red 122 | 30 g | 13.6% | Charge controlling agent | 15 g | 6.8% | — | — | — |
| | 1-3Y | C.I. pigment yellow 74 | 30 g | 13.6% | Charge controlling agent | 15 g | 6.8% | — | — | — |
| | 1-3K | Carbon black (Mogul L) | 30 g | 13.6% | Charge controlling agent | 15 g | 6.8% | — | — | — |
| 1-4 | 1-4C | C.I. pigment blue 15:3 | 30 g | 10.0% | — | — | — | WEP-5 | 94 g | 31.4% |
| | 1-4M | C.I. pigment red 122 | 30 g | 10.0% | — | — | — | WEP-5 | 94 g | 31.4% |
| | 1-4Y | C.I. pigment yellow 74 | 30 g | 10.0% | — | — | — | WEP-5 | 94 g | 31.4% |
| | 1-4K | Carbon black (Mogul L) | 30 g | 10.0% | — | — | — | WEP-5 | 94 g | 31.4% |
| 1-5 | 1-5 | — | — | — | Charge controlling agent | 15 g | 5.3% | WEP-5 | 94 g | 33.0% |
| 1-6 | 1-6C | C.I. pigment blue 15:3 | 30 g | 9.5% | Charge controlling agent | 15 g | 4.8% | WEP-5 | 94 g | 29.9% |
| | 1-6M | C.I. pigment red 122 | 30 g | 9.5% | Charge controlling agent | 15 g | 4.8% | WEP-5 | 94 g | 29.9% |

TABLE 1-continued

| | | Material added at miniemulsion polymerization | | | | | | | | |
|---|---|---|---|---|---|---|---|---|---|---|
| | | Pigment | | | Charge controlling agent | | | Wax | | |
| Particle structure | Particle | Pigment | Addition amount of pigment | Ratio of pigment in particle | Charge controlling agent | Addition amount of charge controlling agent | Ratio of charge controlling agent in particle | Wax | Addition amount of wax | Ratio of wax in particle |
| | 1-6Y | C.I. pigment yellow 74 | 30 g | 9.5% | Charge controlling agent | 15 g | 4.8% | WEP-5 | 94 g | 29.9% |
| | 1-6K | Carbon black (Mogul L) | 30 g | 9.5% | Charge controlling agent | 15 g | 4.8% | WEP-5 | 94 g | 29.9% |
| 2-1 | 2-1C | C.I. pigment blue 15:3 | 30 g | 12.6% | — | — | — | — | — | — |
| | 2-1M | C.I. pigment red 122 | 30 g | 12.6% | — | — | — | — | — | — |
| | 2-1Y | C.I. pigment yellow 74 | 30 g | 12.6% | — | — | — | — | — | — |
| | 2-1K | Carbon black (Mogul L) | 30 g | 12.6% | — | — | — | — | — | — |
| 2-2 | 2-2 | — | — | — | Charge controlling agent | 15 g | 6.7% | — | — | — |
| 2-3 | 2-3C | C.I. pigment blue 15:3 | 30 g | 11.9% | Charge controlling agent | 15 g | 5.9% | — | — | — |
| | 2-3M | C.I. pigment red 122 | 30 g | 11.9% | Charge controlling agent | 15 g | 5.9% | — | — | — |
| | 2-3Y | C.I. pigment yellow 74 | 30 g | 11.9% | Charge controlling agent | 15 g | 5.9% | — | — | — |
| | 2-3K | Carbon black (Mogul L) | 30 g | 11.9% | Charge controlling agent | 15 g | 5.9% | — | — | — |

TABLE 2

| | | Material added at miniemulsion polymerization | | | | | | | | |
|---|---|---|---|---|---|---|---|---|---|---|
| | | Pigment | | | Charge controlling agent | | | Wax | | |
| Particle structure | Particle | Pigment | Addition amount of pigment | Ratio of pigment in particle | Charge controlling agent | Addition amount of charge controlling agent | Ratio of charge controlling agent in particle | Wax | Addition amount of wax | Ratio of wax in particle |
| 2-4 | 2-4C | C.I. pigment blue 15:3 | 30 g | 9.1% | — | — | — | WEP-5 | 94 g | 28.4% |
| | 2-4M | C.I. pigment red 122 | 30 g | 9.1% | — | — | — | WEP-5 | 94 g | 28.4% |
| | 2-4Y | C.I. pigment yellow 74 | 30 g | 9.1% | — | — | — | WEP-5 | 94 g | 28.4% |
| | 2-4K | Carbon black (Mogul L) | 30 g | 9.1% | — | — | — | WEP-5 | 94 g | 28.4% |
| 2-5 | 2-5 | — | — | — | Charge controlling agent | 15 g | 4.7% | WEP-5 | 94 g | 29.7% |
| 2-6 | 2-6C | C.I. pigment blue 15:3 | 30 g | 8.7% | Charge controlling agent | 15 g | 4.3% | WEP-5 | 94 g | 27.1% |
| | 2-6M | C.I. pigment red 122 | 30 g | 8.7% | Charge controlling agent | 15 g | 4.3% | WEP-5 | 94 g | 27.1% |
| | 2-6Y | C.I. pigment yellow 74 | 30 g | 8.7% | Charge controlling agent | 15 g | 4.3% | WEP-5 | 94 g | 27.1% |
| | 2-6K | Carbon black (Mogul L) | 30 g | 8.7% | Charge controlling agent | 15 g | 4.3% | WEP-5 | 94 g | 27.1% |

TABLE 2-continued

| | | Material added at miniemulsion polymerization | | | | | | | | |
|---|---|---|---|---|---|---|---|---|---|---|
| | | Pigment | | | Charge controlling agent | | | Wax | | |
| Particle structure | Particle | Pigment | Addition amount of pigment | Ratio of pigment in particle | Charge controlling agent | Addition amount of charge controlling agent | Ratio of charge controlling agent in particle | Wax | Addition amount of wax | Ratio of wax in particle |
| 3-1 | 3-1C | C.I. pigment blue 15:3 | 30 g | 4.6% | — | — | — | — | — | — |
| | 3-1M | C.I. pigment red 122 | 30 g | 4.6% | — | — | — | — | — | — |
| | 3-1Y | C.I. pigment yellow 74 | 30 g | 4.6% | — | — | — | — | — | — |
| | 3-1K | Carbon black (Mogul L) | 30 g | 4.6% | — | — | — | — | — | — |
| 3-2 | 3-2 | — | — | — | Charge controlling agent | 15 g | | — | — | — |
| 3-3 | 3-3C | C.I. pigment blue 15:3 | 30 g | 4.5% | Charge controlling agent | 15 g | 2.3% | — | — | — |
| | 3-3M | C.I. pigment red 122 | 30 g | 4.5% | Charge controlling agent | 15 g | 2.3% | — | — | — |
| | 3-3Y | C.I. pigment yellow 74 | 30 g | 4.5% | Charge controlling agent | 15 g | 2.3% | — | — | — |
| | 3-3K | Carbon black (Mogul L) | 30 g | 4.5% | Charge controlling agent | 15 g | 2.3% | — | — | — |
| 3-4 | 3-4C | C.I. pigment blue 15:3 | 30 g | 4.1% | — | — | — | WEP-5 | 94 g | 12.7% |
| | 3-4M | C.I. pigment red 122 | 30 g | 4.1% | — | — | — | WEP-5 | 94 g | 12.7% |
| | 3-4Y | C.I. pigment yellow 74 | 30 g | 4.1% | — | — | — | WEP-5 | 94 g | 12.7% |
| | 3-4K | Carbon black (Mogul L) | 30 g | 4.1% | — | — | — | WEP-5 | 94 g | 12.7% |
| 3-5 | 3-5 | — | — | — | Charge controlling agent | 15 g | 2.1% | WEP-5 | 94 g | 13.0% |
| 3-6 | 3-6C | C.I. pigment blue 15:3 | 30 g | 4.0% | Charge controlling agent | 15 g | 2.0% | WEP-5 | 94 g | 12.4% |
| | 3-6M | C.I. pigment red 122 | 30 g | 4.0% | Charge controlling agent | 15 g | 2.0% | WEP-5 | 94 g | 12.4% |
| | 3-6Y | C.I. pigment yellow 74 | 30 g | 4.0% | Charge controlling agent | 15 g | 2.0% | WEP-5 | 94 g | 12.4% |
| | 3-6K | Carbon black (Mogul L) | 30 g | 4.0% | Charge controlling agent | 15 g | 2.0% | WEP-5 | 94 g | 12.4% |

TABLE 3

| | | Material added at miniemulsion polymerization | | | | | | | | |
|---|---|---|---|---|---|---|---|---|---|---|
| | | Pigment | | | Charge controlling agent | | | Wax | | |
| Particle structure | Particle | Pigment | Addition amount of pigment | Ratio of pigment in particle | Charge controlling agent | Addition amount of charge controlling agent | Ratio of charge controlling agent in particle | Wax | Addition amount of wax | Ratio of wax in particle |
| 1-7 | 1-7 | — | — | — | — | — | — | WEP-5 | 94 g | 34.9% |
| 2-7 | 2-7 | — | — | — | — | — | — | WEP-5 | 94 g | 31.2% |
| 3-7 | 3-7 | — | — | — | — | — | — | WEP-5 | 94 g | 13.2% |

<Production of Wax Dispersion Solution>

Wax WEP-5 (200 parts), ion exchanged water (784 parts) and anionic surfactant (16 parts) (Newlex R*: made by Nippon Oil & Fats Co., Ltd.) were dissolved in an autoclave, and dispersed by using a homogenizer to prepare a wax dispersion solution (average particle size: 500 nm).

<Production of Colorant Dispersion Solution>

(Colorant Dispersion Solution C1)

| | |
|---|---|
| Pigment C.I. Pigment Blue 15:3 | 30 parts |
| Sodium dodecyl sulfate | 10 parts |
| Ion exchanged water | 200 parts |

The above-mentioned components were dispersed by using a sand grinder mill to obtain a colorant dispersion solution C1 having a volume-average particle size (D50) of 170 nm.

(Colorant Dispersion Solution M1)

The same method as the preparation method of the colorant dispersion solution C1 was carried out except that the pigment was changed to C.I. Pigment Red 122, a colorant dispersion solution M1 was prepared. The volume-average particle size (D50) of the pigment fine particles was 180 nm.

(Colorant Dispersion Solution Y1)

The same method as the preparation method of the colorant dispersion solution C1 was carried out except that the pigment was changed to C. I. Pigment Yellow 74, a colorant dispersion solution Y1 was prepared. The volume-average particle size (D50) of the pigment fine particles was 150 nm.

(Colorant Dispersion Solution K1)

The same method as the preparation method of the colorant dispersion solution C1 was carried out except that the pigment is changed to carbon black (Mogul L; made by Cabot Corporation), a colorant dispersion solution K1 was prepared. The volume-average particle size (D50) of the pigment fine particles was 160 nm.

<Preparation of Charge-controlling Agent Dispersion Solution>

| | |
|---|---|
| Charge-controlling agent represented by formula (I) | 15 parts |
| Sodium dodecyl sulfate | 37.5 parts |
| Ion exchanged water | 750 parts |

The above-mentioned components were dispersed by using a sand grinder mill to obtain a charge-controlling agent dispersion solution having a volume-average particle size (D50) of 320 nm.

Examples and Comparative Examples

Toners were manufactured by using the following methods, and the resulting toners were evaluated with respect to the transmission density and charging stability.

<Preparation of Toner>

To a reaction container (four-neck flask) equipped with a temperature sensor, a cooling tube, a nitrogen gas directing device and a stirring device were charged a mixed solution of latex fine particles shown in Tables 4 to 8, and 900 g of ion exchanged water, and stirred therein. After the temperature inside the container had been adjusted to 30° C., a 2N sodium hydroxide aqueous solution was added to this solution to adjust the pH to 8 to 10.0.

A solution, prepared by dissolving 65.0 g of magnesium chloride 6-hydrate in 1000 ml of ion exchanged water, was dripped therein at 30° C. in 10 minutes, while being stirred. After having been left for 3 minutes, this was heated to 92° C. to form associated particles. In this state, the particle size of the associated particles was measured by "Coulter Counter TA-II", and at the time when the number-average particle size was set to 4.5 μm, an aqueous solution, prepared by dissolving 80.4 g of sodium chloride in 1000 ml of ion exchanged water, was added thereto to stop the growth of the particles, and this was further heated and stirred at a solution temperature of 94° C. as a maturing process so that the fusion of the particles and the phase separation of the crystalline substance were continued (maturing process). In this state, the shape of the associated particles was measured by a "FPIA-2000", and at the time when the shape coefficient had reached 0.960, this was cooled to 30° C. and the stirring process was stopped. The associated particles thus formed were filtered, and washed with ion exchanged water at 45° C. repeatedly, and then dried by hot air at 40° C. so that toner particles were obtained. The number-average particle size of the toner particles and the shape coefficient were again measured and found to be 4.5 μm and 0.962 respectively.

Hydrophobic silica (number-average primary particle size=12 nm, degree of hydrophobicity=68) was added to the toner particles at a rate so as to reach 1.0% by weight and hydrophobic titanium oxide (number-average primary particles size=20 nm, degree of hydrophobicity=63) was also added thereto at a rate so as to reach 1.2% by weight, and this was mixed by a Henschel mixer to produce cyan toner 1. Here, the shape and the particle size of the toner were not changed by the addition of the hydrophobic silica and hydrophobic titanium oxide.

<Evaluation>

(Transmission Density (TD))

By using toners obtained through the respective examples or comparative examples and a magicolor2300DL (Minolta QMS Co., Ltd.), a solid image having an amount of toner adhesion of 3.5 g/m$^2$ was printed on CF paper (basis weight 80 g/m$^2$), which is standard paper for use in CF900. The transmission density of the resulting image was measured by using a transmission densitometer TD904 (made by Macbeth Co., Ltd.), and the value of the transmission density in the maximum peak was used.

(Charging Stability)

Toners were left for 24 hours under L/L environment (10° C., 15% RH) as well as under H/H environment (30° C., 85% RH), and a difference between the quantities of charge of the respective toners was defined as the fluctuation width of the quantity of charge. For example, in the case when the quantity of charge in the toner that has been left under the L/L environment is 40 μC/g, while the quantity of charge in the toner that has been left under the H/H environment is 15 μC/g, the fluctuation width of the quantity of charge is 25 μC/g. Here, the quantity of charge in the toner was measured by using a method referred to as "suction-type Faraday cage". In this method, toner particles on a developing roll are directly sucked and collected into the Faraday cage by using a high power air suction device.

TABLE 4

| | Toner constituent material (mixed solution-constituent material) (conversion to solids (g)) | | | | Ratio of pigment | Evaluation results: TD at adhesion amount of | Evaluation results: Dispersion particle size of pigment |
|---|---|---|---|---|---|---|---|
| | Particle 1 | Particle 2 | Dispersion 1 | Dispersion 2 | in toner | 3.5 g/m$^2$ | in toner [nm] |
| Example 1C | 1-1C (268.8) | 1-7 (151.2) | — | — | 9.3% | 1.33 | 135 |
| Example 2C | 2-1C (235.2) | 1-7 (184.8) | — | — | 7.1% | 1.12 | 116 |
| Example 3C | 3-1C (268.8) | 1-7 (151.2) | — | — | 3.0% | 0.93 | 94 |
| Example 4C | 1-1C (365.4) | — | Wax dispersion solution (54.6) | — | 12.7% | 1.63 | 137 |
| Example 5C | 2-1C (365.4) | — | Wax dispersion solution (54.6) | — | 11.0% | 1.57 | 118 |
| Example 6C | 3-1C (365.4) | — | Wax dispersion solution (54.6) | — | 4.0% | 1.02 | 97 |
| Example 7C | 1-4C (420) | — | — | — | 10.0% | 1.45 | 129 |
| Example 8C | 2-4C (420) | — | — | — | 9.1% | 1.31 | 123 |
| Example 9C | 3-4C (420) | — | — | — | 4.1% | 1.05 | 112 |
| Example 10C | 1-6C (420) | — | — | — | 9.5% | 1.34 | 134 |
| Example 11C | 2-6C (420) | — | — | — | 8.7% | 1.38 | 126 |
| Example 12C | 3-6C (420) | — | — | — | 4.0% | 1.02 | 114 |
| Comparative Example 1C | 3-7 (390) | — | Colorant dispersion solution C1 (30) | — | 4.0% | 0.85 | 362 |
| Comparative Example 2C | 3-8 (335.4) | — | Colorant dispersion solution C1 (30) | Wax dispersion solution (54.6) | 4.0% | 0.81 | 385 |

TABLE 5

| | Toner constituent material (mixed solution-constituent material) (conversion to solids (g)) | | | | Ratio of pigment | Evaluation results: TD at adhesion amount of | Evaluation results: Dispersion particle size of pigment |
|---|---|---|---|---|---|---|---|
| | Particle 1 | Particle 2 | Dispersion 1 | Dispersion 2 | in toner | 3.5 g/m$^2$ | in toner [nm] |
| Example 1M | 1-1M (268.8) | 1-7(151.2) | — | — | 9.3% | 1.25 | 133 |
| Example 2M | 2-1M (235.2) | 1-7(184.8) | — | — | 7.1% | 1.05 | 127 |
| Example 3M | 3-1M (268.8) | 1-7(151.2) | — | — | 3.0% | 0.91 | 103 |
| Example 4M | 1-1M (365.4) | — | Wax dispersion solution (54.6) | — | 12.7% | 1.53 | 150 |
| Example 5M | 2-1M (365.4) | — | Wax dispersion solution (54.6) | — | 11.0% | 1.47 | 129 |
| Example 6M | 3-1M (365.4) | — | Wax dispersion solution (54.6) | — | 4.0% | 0.95 | 106 |
| Example 7M | 1-4M (420) | — | — | — | 10.0% | 1.36 | 142 |
| Example 8M | 2-4M (420) | — | — | — | 9.1% | 1.23 | 135 |
| Example 9M | 3-4M (420) | — | — | — | 4.1% | 0.98 | 123 |
| Example 10M | 1-6M (420) | — | — | — | 9.5% | 1.25 | 147 |
| Example 11M | 2-6M (420) | — | — | — | 8.7% | 1.29 | 136 |
| Example 12M | 3-6M (420) | — | — | — | 4.0% | 0.94 | 124 |
| Comparative Example 1M | 3-7 (390) | — | Colorant dispersion solution M1 (30) | — | 4.0% | 0.81 | 395 |
| Comparative Example 2M | 3-8 (335.4) | — | Colorant dispersion solution M1 (30) | Wax dispersion solution (54.6) | 4.0% | 0.77 | 413 |

TABLE 6

| | Toner constituent material (mixed solution-constituent material) (conversion to solids (g)) | | | | Ratio of pigment | Evaluation results: TD at adhesion amount of | Evaluation results: Dispersion particle size of pigment |
|---|---|---|---|---|---|---|---|
| | Particle 1 | Particle 2 | Dispersion 1 | Dispersion 2 | in toner | 3.5 g/m$^2$ | in toner [nm] |
| Example 1Y | 1-1Y (268.8) | 1-7(151.2) | — | — | 9.3% | 1.21 | 115 |
| Example 2Y | 2-1Y (235.2) | 1-7(184.8) | — | — | 7.1% | 1.05 | 98 |
| Example 3Y | 3-1Y (268.8) | 1-7(151.2) | — | — | 3.0% | 0.90 | 83 |
| Example 4Y | 1-1Y (365.4) | — | Wax dispersion solution (54.6) | — | 12.7% | 1.47 | 118 |
| Example 5Y | 2-1Y (365.4) | — | Wax dispersion solution (54.6) | — | 11.0% | 1.41 | 101 |

TABLE 6-continued

| | Toner constituent material (mixed solution-constituent material) (conversion to solids (g)) | | | | Ratio of pigment | Evaluation results: TD at adhesion amount of 3.5 g/m$^2$ | Evaluation results: Dispersion particle size of pigment |
|---|---|---|---|---|---|---|---|
| | Particle 1 | Particle 2 | Dispersion 1 | Dispersion 2 | in toner | | in toner [nm] |
| Example 6Y | 3-1Y (365.4) | — | Wax dispersion solution (54.6) | — | 4.0% | 0.92 | 84 |
| Example 7Y | 1-4Y (420) | — | — | — | 10.0% | 1.31 | 111 |
| Example 8Y | 2-4Y (420) | — | — | — | 9.1% | 1.18 | 106 |
| Example 9Y | 3-4Y (420) | — | — | — | 4.1% | 0.95 | 96 |
| Example 10Y | 1-6Y (420) | — | — | — | 9.5% | 1.21 | 115 |
| Example 11Y | 2-6Y (420) | — | — | — | 8.7% | 1.24 | 108 |
| Example 12Y | 3-6Y (420) | — | — | — | 4.0% | 0.93 | 97 |
| Comparative Example 1Y | 3-7 (390) | — | Colorant dispersion solution Y1 (30) | — | 4.0% | 0.83 | 326 |
| Comparative Example 2Y | 3-8 (335.4) | — | Colorant dispersion solution Y1 (30) | Wax dispersion solution (54.6) | 4.0% | 0.73 | 342 |

TABLE 7

| | Toner constituent material (mixed solution-constituent material) (conversion to solids (g)) | | | | Ratio of pigment | Evaluation results: TD at adhesion amount of 3.5 g/m$^2$ | Evaluation results: Dispersion particle size of pigment |
|---|---|---|---|---|---|---|---|
| | Particle 1 | Particle 2 | Dispersion 1 | Dispersion 2 | in toner | | in toner [nm] |
| Example 1K | 1-1K (268.8) | 1-7(151.2) | — | — | 9.3% | 1.62 | 122 |
| Example 2K | 2-1K (235.2) | 1-7(184.8) | — | — | 7.1% | 1.34 | 104 |
| Example 3K | 3-1K (268.8) | 1-7(151.2) | — | — | 3.0% | 1.23 | 85 |
| Example 4K | 1-1K (365.4) | — | Wax dispersion solution (54.6) | — | 12.7% | 1.89 | 123 |
| Example 5K | 2-1K (365.4) | — | Wax dispersion solution (54.6) | — | 11.0% | 1.85 | 106 |
| Example 6K | 3-1K (365.4) | — | Wax dispersion solution (54.6) | — | 4.0% | 1.22 | 87 |
| Example 7K | 1-4K (420) | — | — | — | 10.0% | 1.74 | 116 |
| Example 8K | 2-4K (420) | — | — | — | 9.1% | 1.57 | 111 |
| Example 9K | 3-4K (420) | — | — | — | 4.1% | 1.26 | 101 |
| Example 10K | 1-6K (420) | — | — | — | 9.5% | 1.61 | 121 |
| Example 11K | 2-6K (420) | — | — | — | 8.7% | 1.66 | 113 |
| Example 12K | 3-6K (420) | — | — | — | 4.0% | 1.22 | 103 |
| Comparative Example 1K | 3-7 (390) | — | Colorant dispersion solution K1 (30) | — | 4.0% | 1.10 | 310 |
| Comparative Example 2K | 3-8 (335.4) | — | Colorant dispersion solution K1 (30) | Wax dispersion solution (54.6) | 4.0% | 0.97 | 347 |

TABLE 8

| | Toner constituent material (mixed solution-constituent material) (conversion to solids (g)) | | | | Ratio of charge controlling agent | Evaluation results: Charging quantity fluctuation | Evaluation results: Dispersion particle size of charge controlling agent |
|---|---|---|---|---|---|---|---|
| | Particle 1 | Particle 2 | Dispersion 1 | Dispersion 2 | in toner | width [μC/g] | in toner [nm] |
| Example 13C | 1-2 (252) | 1-4C(168) | — | — | 4.7% | 21 | 180 |
| Example 14C | 2-2 (252) | 1-4C(168) | — | — | 4.0% | 25 | 152 |
| Example 15C | 3-2 (252) | 1-4C(168) | — | — | 1.4% | 30 | 110 |
| Example 16C | 1-3C (268.8) | 1-7(151.2) | — | — | 4.4% | 22 | 195 |
| Example 17C | 2-3C (268.8) | 1-7(151.2) | — | — | 3.8% | 27 | 160 |
| Example 18C | 3-3C (268.8) | 1-7(151.2) | — | — | 1.5% | 29 | 132 |
| Example 19C | 1-6C (420) | — | — | — | 4.8% | 18 | 197 |
| Example 20C | 2-6C (420) | — | — | — | 4.3% | 22 | 154 |
| Example 21C | 3-6C (420) | — | — | — | 2.0% | 25 | 121 |
| Comparative Example 3C | 3-7 (390) | — | Colorant dispersion solution C1 (30) | — | 0% | 42 | — |
| Comparative Example 4C | 3-8 (375) | — | Colorant dispersion solution C1 (30) | Charge controlling agent dispersion solution (15) | 2.0% | 40 | 423 |

<Measuring Method>

(Dispersion Particle Sizes of Colorant Particles and Charge-controlling-agent Particles)

By using a transmission-type electron microscope (TEM), photographs of the toner particle cross-section were taken at three different locations at a magnification of ×40,000, and the images were taken into a personal computer so that the average particle size was found through image processing.

(Particle Size of Toner Particles)

The particle size of the toner was measured by a Coulter Multisizer II (made by Beckman Coulter, Inc.). In the present invention, the Coulter Multisizer II was used, with an interface used for outputting the grain size distribution (made by Beckman Coulter, Inc.) and a personal computer being connected thereto. With the aperture of the Coulter Multisizer II being set to 50 μm, the volume distribution of the toner having a particle size of not less than 0.99 μm (for example, 2 to 40 μm) was measured so that the grain-size distribution and the average particle size were calculated.

(Measuring Conditions)

(1) Aperture: 50 μm (2) Sample preparation method (in the case of measuring the toner particle size): To an electrolytic solution (ISOTON-II-pc (made by Beckman Counter, Inc.)) (50 to 100 ml) was added an appropriate amount of a surfactant (neutral detergent) and stirred, and to this further added 10 to 20 mg of a measuring sample. The sample was prepared by subjecting this system to a dispersion treatment for one minute by using an ultrasonic dispersing machine. (3) Sample preparation method (in the case of measuring the particle size of core particles): To an electrolytic solution (ISOTON-II-pc (made by Beckman Counter, Inc.)) (50 to 100 ml) was directly added an appropriate amount of the solution of the associated particles so that the sample was prepared.

(Volume-average Particle Sizes of Resin Particles, Colorant Particles and Charge-controlling Agent Particles in the Dispersion Solution)

The volume-average particle sizes of particles in the dispersion solution were measured by a Microtrack UPA150 (made by Honeywell International Inc.) that uses a dynamic light-scattering method. The measuring sample was subjected to a dispersion treatment for 3 minutes by an ultrasonic dispersing machine.

(Measurements for Weight-Average Molecular Weight)

The weight-average molecular weight of the resin particles is a molecular weight in styrene conversion measured by using a GPC (gel permeation chromatography).

With respect to the measuring method of the molecular weight of resin by using a GPC, 1 cc of THF is added to 0.5 to 5.0 mg (more specifically, 1 mg) of a test sample, and this is stirred at room temperature by using a magnetic stirrer or the like to be sufficiently dissolved therein.

After having been treated with a membrane filter having a pore size of 0.45 to 0.50 μm, this is injected into the GPC. With respect to the measuring conditions of the GPC, the column was stabilized at 40° C., and about 10 μl of the sample having a concentration of 1 mg/cc is injected while THF is allowed to flow at a flow rate of 0.35 cc per minute; thus, measurements were carried out. With respect to the column, commercial polystyrene gel columns are preferably used in combination. Specific examples thereof include TSKgel Super HZ1000, HZ2000, HZ2500, HZ3000, HZ4000, HZM-N, HZM-M, HZM-H, TSKguardcolumn SuperHZ-L and HZ-H that are used in combination.

With respect to the detector, a refractive-index detector (RI detector) or an UV detector may be preferably used. With respect to the molecular-weight measurements of the sample, the molecular-weight distribution of the sample is calculated by using a calibration curve measured by the use of single-dispersion polystyrene standard particles. With respect to calibration-curve measuring polystyrene, about ten points thereof are used.

(Wax Softening Point)

A differential scanning calorimeter (DSC-200: made by Seiko Instruments Inc.) was used. Specifically, 10 mg of a sample to be measured was precisely weighed, and this was put into an aluminum pan, while alumina was put into an aluminum pan so as to be used as reference, and was heated to 200° C. from normal temperature at a temperature-rise rate of 30° C./min, and this was then cooled, and subjected to measurements in the range of 20° C. to 200° C. at a temperature-rise rate of 10° C./min; thus, the main heat-absorption peak in this was defined as the softening point.

EFFECT OF THE INVENTION

Since the present invention makes it possible to disperse colorant particles and/or charge-controlling agent particles in resin particles uniformly, it becomes possible to ensure sufficient toner quality (image density and/or charging stability) even in the case of a low content. Since the above-mentioned materials can be dispersed at high contents, it becomes possible to further improve the toner quality.

More specifically, since the colorant particles are uniformly dispersed in the resin particles, the colorant particles are also uniformly dispersed in toner particles that are formed by allowing the resin particles to aggregate/fuse to one another. Consequently, it becomes possible to ensure sufficient image density even in the case of a low content and a low amount of adhesion. The dispersion with a high content further makes it possible to ensure sufficient image density even in the case of a low amount of adhesion. Since the colorant becomes less susceptible to exposure onto the surface, the chargeability and durability are improved.

Since the charge-controlling agent particles are uniformly dispersed in the resin particles, the charge-controlling particles are also uniformly dispersed in the toner particles that are formed by allowing the resin particles to aggregate/fuse to one another, with the result that the charge-controlling agent particles are firmly secured to the inside of the toner particle and the surface thereof uniformly. Consequently, it becomes possible to provide a toner that exerts sufficient chargeability even in the case of a low content, and is stable against environmental fluctuations. The dispersion with a high content further makes it possible to improve the chargeability.

What is claimed is:

1. A resin particle for a toner, the resin particle comprising colorant particles and resin, wherein the resin particle has a structure having a center portion and a functional layer or a structure having a center portion, a functional layer and a surface layer, and the functional layer comprises the colorant particles contained therein through a miniemulsion method.

2. The resin particle of claim 1, wherein the resin particle has a structure having a center portion and a functional layer provided thereon and the content of the colorant is in a range from 3 to 14% by weight with respect to the resin particle for toner.

3. The resin particle of claim 1, further comprising a wax, the wax being contained through a miniemulsion method.

4. The resin particle of claim 1, further comprising charge-controlling agent particles, the charge-controlling agent particles being contained through a miniemulsion method.

5. A toner, comprising toner particles prepared by aggregating resin particles, wherein at least one of the resin particles has a structure having a center portion and a functional layer or a structure having a center portion, a functional layer and a surface layer, the functional layer containing colorant particles provided through a miniemulsion method, and an average dispersion particle size of the colorant particles in the toner being not more than 200 nm.

6. The toner of claim 5, wherein a cyan colorant, a magenta colorant or an yellow colorant is contained, and the toner has a transmission density of not less than 0.9 in the case of a toner adhesion amount of 3.5 $g/m^2$.

7. The toner of claim 5, wherein the toner is a black toner, and the toner has a transmission density of not less than 1.2 in the case of a toner adhesion amount of 3.5 $g/m^2$.

8. The toner of claim 5, wherein an average dispersion particle size of the colorant particles in the toner is in a range of 50 to 160 nm.

9. The toner of claim 5, wherein the colorant particles are contained in the toner particles at not less than 2% by weight.

10. The toner of claim 5, wherein charge controlling agent particles are further contained in the resin particles through a miniemulsion method, and an average dispersion particle size of the charge controlling agent particles in the toner is not more than 300 nm.

11. The toner of claim 10, wherein the charging quantity fluctuation width caused when the toner is left under L/L environment (10° C., 15% RH) and H/H environment (30° C., 85% RH) is not more than 35 μC/g.

12. The toner of claim 10, wherein the charge controlling agent is contained in the toner particles at not less than 0.5% by weight.

13. The resin particle of claim 1, having a center portion, a functional layer and a surface layer, and wherein the content of the colorant is in a range from 3 to 6% by weight with respect to the resin particle.

14. The resin particle of claim 1, wherein an average dispersion particle size of the colorant particles in the resin particle is not more than 200 nm.

15. A toner comprising toner particles employing a resin particle for the toner, wherein the resin particle has a structure having a center portion and a functional layer provided thereon or a structure having a center portion, a functional layer and a surface layer, wherein the functional layer contains colorant particles provided through a miniemulsion method.

16. The toner of claim 15, wherein a cyan colorant, a magenta colorant or a yellow colorant is present, and the toner has a transmission density of not less than 0.9 in the case of a toner adhesion amount of 3.5 $g/m^2$.

17. The toner of claim 15, wherein the toner is a black toner, and the toner has a transmission density of not less than 1.2 in the case of a toner adhesion amount of 3.5 $g/m^2$.

18. The toner of claim 15, wherein an average dispersion particle size of the colorant particles in the toner is in a range of 50 to 160 nm.

19. The toner of claim 15, wherein the colorant particles are contained in the toner particles at not less than 2% by weight.

20. The toner of claim 15, wherein charge controlling agent particles are further contained in the resin particles through a miniemulsion method, and an average dispersion particle size of the charge controlling agent particles in the toner is not more than 300 nm.

21. The toner of claim 20, wherein the charging quantity fluctuation width caused when the toner is left under L/L environment (10° C., 15% RH) and H/H environment (30° C., 85% RH) is not more than 35 mμC/g.

22. The toner of claim 20, wherein the charge controlling agent is contained in the toner particles at not less than 0.5 by weight.

* * * * *